US008808643B1

(12) United States Patent
Benner et al.

(10) Patent No.: US 8,808,643 B1
(45) Date of Patent: Aug. 19, 2014

(54) FLUIDICS PLATFORM AND METHOD FOR SAMPLE PREPARATION AND ANALYSIS

(75) Inventors: W. Henry Benner, Danville, CA (US); John M. Dzenitis, Danville, CA (US); William J Benett, Livermore, CA (US); Brian R. Baker, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 260 days.

(21) Appl. No.: 13/228,391

(22) Filed: Sep. 8, 2011

(51) Int. Cl.
*B01L 3/02* (2006.01)

(52) U.S. Cl.
USPC ..... 422/509; 422/500; 422/501; 422/502; 422/503; 436/180

(58) Field of Classification Search
USPC ..... 422/50, 500–503, 509; 436/180
See application file for complete search history.

(56) References Cited

U.S. PATENT DOCUMENTS

| | | | | |
|---|---|---|---|---|
| 5,234,809 | A | 8/1993 | Boom et al. | |
| 6,693,709 | B2 | 2/2004 | Wechsler et al. | |
| 8,203,784 | B2 | 6/2012 | Nolte et al. | |
| 2002/0064880 | A1 * | 5/2002 | Merten et al. | 436/43 |
| 2004/0229349 | A1 | 11/2004 | Daridon | |
| 2008/0057572 | A1 | 3/2008 | Petersen | |
| 2010/0014157 | A1 | 1/2010 | Nolte | |

OTHER PUBLICATIONS

Boom, R. et al., *Rapid and Simple Method for Purification of Nucleic Acids*, J. Clin. Microbial, 1989, 28, pp. 495-503.

Bush, C. et al., *Rapid Isolation of genomic DNA from whole blood to borosilicate particles*, Clin. Chem., 1991, 37, pp. 1060.

Cepheid, *SmartCycler System Brochure*, Retrieved on Jan. 31, 2013.

Smiths Detection, *Bio-Seeq PLUS Brochure*, Retrieved on Jan. 31, 2013.

Smith, M.C. et al., *An integrated portable hand-held analyser for real-time isothermal nucleic acid amplification*, Analytica Chimica Acta, 2007, 598, pp. 286-294.

Roche, *SeptiFast—The Impact of Rapid Results*, 2007.

Cepheid, *GeneXpert System Brochure*, Retrieved on Feb. 12, 2013.

Smith Detection, *Bio-Seeq Product Summary*, 2009.

Promega Technical Manual 284, *Maxwell 16 DNA Purification Kits*, 2012.

Restriction Requirement issued for U.S. Appl. No. 13/228,361, filed Sep. 8, 2011, in the name of Vincent J. Riot, mailed on Feb. 4, 2013.

Non-Final Office Action issued for U.S. Appl. No. 13/228,384, filed Sep. 8, 2011, in the name of Vincent J. Riot, mailed on Dec. 4, 2012.

Non-Final Office issued for U.S. Appl. No. 13/228,361, filed Sep. 8, 2011in the name of Vincent J. Riot mailed on Nov. 13, 2013.

(Continued)

*Primary Examiner* — Jyoti Nagpaul
(74) *Attorney, Agent, or Firm* — Steinfl & Bruno, LLP

(57) ABSTRACT

Herein provided are fluidics platform and method for sample preparation and analysis. The fluidics platform is capable of analyzing DNA from blood samples using amplification assays such as polymerase-chain-reaction assays and loop-mediated-isothermal-amplification assays. The fluidics platform can also be used for other types of assays and analyzes. In some embodiments, a sample in a sealed tube can be inserted directly. The following isolation, detection, and analyzes can be performed without a user's intervention. The disclosed platform may also comprises a sample preparation system with a magnetic actuator, a heater, and an air-drying mechanism, and fluid manipulation processes for extraction, washing, elution, assay assembly, assay detection, and cleaning after reactions and between samples.

15 Claims, 4 Drawing Sheets

(56) References Cited

OTHER PUBLICATIONS

Final Office Action issued for U.S. Appl. No. 13/228,384, filed Sep. 8, 2011in the name of Vincent J. Riot mailed on Nov. 6, 2013.

Murray, R. et al. Feedback Systems: An Introduction for Scientists and Engineers. Princeton University Press , Princeton, NJ. (2008) Chapter 10, pp. 293-314.

* cited by examiner

FLUIDICS PLATFORM AND METHOD FOR SAMPLE PREPARATION AND ANALYSIS

STATEMENT OF GOVERNMENT GRANT

The United States Government has rights in this invention pursuant to Contract No. DE-AC52-07NA27344 between the United States Department of Energy and Lawrence Livermore National Security, LLC for the operation of Lawrence Livermore National Laboratory.

CROSS REFERENCE TO RELATED APPLICATIONS

This application is related to U.S. patent application entitled "A SYSTEM AND METHOD FOR MEASURING FLUORESCENCE OF A SAMPLE" Ser. No. 13/228,361, filed on even date herewith, to U.S. patent application entitled "A FLUIDICS PLATFORM AND METHOD FOR SAMPLE PREPARATION" Ser. No. 13/228,370, filed on even date herewith, and to U.S. patent application entitled "A FLUIDICS CARTRIDGE AND REACTION PLATFORM" Ser. No. 13/228,384, filed on even date herewith, the disclosure of each of which is incorporated herein by reference in its entirety.

FIELD

The present disclosure relates to fluidics platforms. In particular, it relates to a fluidics platform and related method for sample preparation and analysis.

SUMMARY

Described herein are fluidics platforms and related methods for sample preparation and analysis.

According to a first aspect of the disclosure, a fluidics platform is described. The fluidics platform comprises at least one reservoir adapted to comprise a fluidic content. The platform also comprises a first multiport valve which has a common port and at least two branch ports. The platform also comprises a pump connected to the common port through a holding coil and a mixing chamber connected to a first branch port of the at least two branch ports. A second branch port of the at least two branch ports is connected to the at least one reservoir. The common port is adapted to switchably connect to one of the at least two branch ports at a time, and the pump is adapted to draw the fluidic content from the at least one reservoir through the second branch port and the common port into the holding coil and to expel the drawn content from the holding coil through the common port and the first branch port into the mixing chamber.

According to a second aspect of the disclosure, a method for transferring a sample is described. The method comprises drawing the sample from a source chamber to a holding chamber; and pushing the sample from the holding chamber to a destination chamber. Particularly, the holding chamber is connected to a common port of a multiport valve; the source chamber is connected to a first branch port of the multiport valve; the destination chamber is connected to a second branch port of the multiport valve; and the common port of the multiport valve switchably connects to only one branch port of the multiport valve at a time.

According to a third aspect of the disclosure, a method for holding a target liquid at a designated position in a tube is described. The method comprises transferring a first amount of gas into the tube, thus forming a first gas plug, transferring the target liquid into the tube, and transferring a second amount of gas into the tube, thus forming a second gas plug, wherein the first and second gas plugs sandwich the target liquid and are adapted to prevent the target liquid from flowing.

The details of one or more embodiments of the disclosure are set forth in the accompanying drawings and the description below. Other features, objects, and advantages will be apparent from the description and drawings, and from the claims.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

DETAILED DESCRIPTION

The terms "reservoir," "tube," "tubing," "coil," "vial," "chamber," and "test tube" are so used in the present disclosure that they are interchangeable. They all refer to containers for holding fluids.

The term "fluidics", "fluidic content", "fluidic input" or "fluidic output" as used herein indicates a substance that continually flows under an applied shear stress. In the sense of the present disclosure, fluid can be liquids, gases, solids, plasma, and colloids, etc. Exemplary types of fluid according to the present disclosure include but are not limited to air, reagent solutions, blood sample, blood serum, blood plasma and fluidic suspension of particles.

Pathogens, such as methicillin-resistant Staphylococcus aureus, are causing more and more problems in hospitals. One approach to identify the pathogen is to culture a blood sample in a commercial system such as the bioMerieux BacT/ALERT® system. Although this approach is accurate, it takes a long time (generally 5 days for a negative determination). In addition, this approach may require separate DNA tests.

Another approach is to manually extract DNA from a blood sample taken from an infected patient and then analyze the DNA extract through PCR reactions. Such an approach is commercially available in Europe (e.g., SeptiFast® by Roche).

Cepheid's GeneXpert® system and Smiths Detection's Bio-Seeq-Clinical® system aim to integrate and automate sample preparation and DNA testing similar to Roche's SeptiFast. But under these systems, blood samples are openly transferred to the test cassettes of these systems, thus increasing the risk of introducing contamination into a sample, between samples, and into the environment or personnel. Moreover, these commercial systems are designed specifically to detect a certain type of pathogen.

In light of the above, the present disclosure discloses a fluidics platform that avoids open transfer of samples and provides flexible customization for analyzing different pathogens. The fluidics platform also allows for automatic analysis of new targets for which no testing procedure is commercially available.

Figure 1:
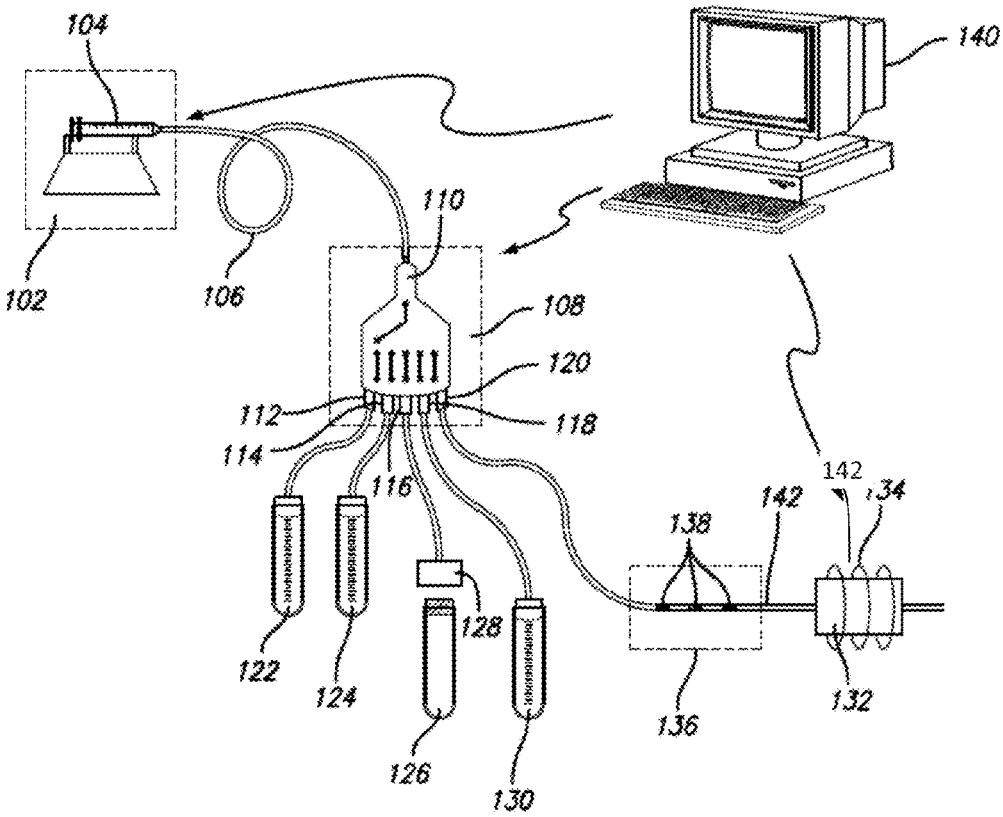
FIG. 1 depicts a fluidics platform according to several embodiments herein described.

FIG. 1 shows schematic illustration of the fluidics platform according to several embodiments herein described. In one embodiment, the fluidics platform uses a syringe pump (102). The syringe (104) of the syringe pump (102) is connected to a holding coil (106), which is further connected to a common port (110) of a multiport valve (108). In other embodiments, a pump that is capable of introducing or withdrawing 1-100 μL of fluidics with at least 5% precision and accuracy can be used as an alternative to the syringe pump.

As also shown in FIG. 1, the multiport valve (108) has a common port (110) and a plurality of branch ports (112, 114, 116, 118, and 120). When in use, the common port (110) is switchably coupled to only one of the branch ports, such as branch port 112 as shown in the figure, so that fluidic communication is built between the common port (110) and the selected branch port.

Each of the branch ports may connect to a reservoir that comprises a sample, a reagent or a waste, etc, such as branch ports 112 and 114 as shown in FIG. 1. Additionally, a branch port may be coupled to an air supply or a mixing chamber (130) where the various reagents and/or samples are drawn to.

According to one embodiment herein described, a sample or reagent reservoir may be connected to a branch port through a sealed access interface (128) of the platform to avoid open transferring of the sample or reagent, thus reducing the risks of infections and/or contaminations. For example, the sealed access interface (128) can be a Vacutainer/Luer-Lock Access interface (128) which allows a common BD Vacutainer® blood test tube (126) to be directly inserted in and thus connecting to the fluidics platform. As another example, a septum-sealed vial may be connected through the sealed access interface (128). Other suitable embodiments of a sealed access interface can be recognized by one skilled in the art upon reading the present disclosure.

According to several embodiments herein described, a branch port can be coupled to a mixing chamber (130), such as the branch port 118 as shown in FIG. 1. An exemplary procedure for transferring a sample or reagent from one of the reservoirs into the reaction (130) through the multiport valve (108) is described below. To transfer a sample or reagent comprised in reservoir 122 into the mixing chamber (130), the multiport valve (108) is first configured to connect the common port (110) to branch port 112. Next, the syringe pump (102) is configured to draw a suitable amount the sample or reagent from reservoir 122, through branch port 112 and the common port (110), to the holding coil (106). The multiport valve (108) is then configured to connect the common port (110) to branch port 118. Then, the syringe pump (102) is configured to expel the sample or reagent from the holding coil (106), through the common port 110 and branch port 118, into the mixing chamber (130). Similarly, the above transfer procedure may be used to transfer samples and/or reagents from any of the attached reservoirs to the mixing chamber (130), or from the mixing chamber (130) to a waste reservoir (220) or to a reaction and detection unit (132) as shown in FIG. 1.

Figure 2:
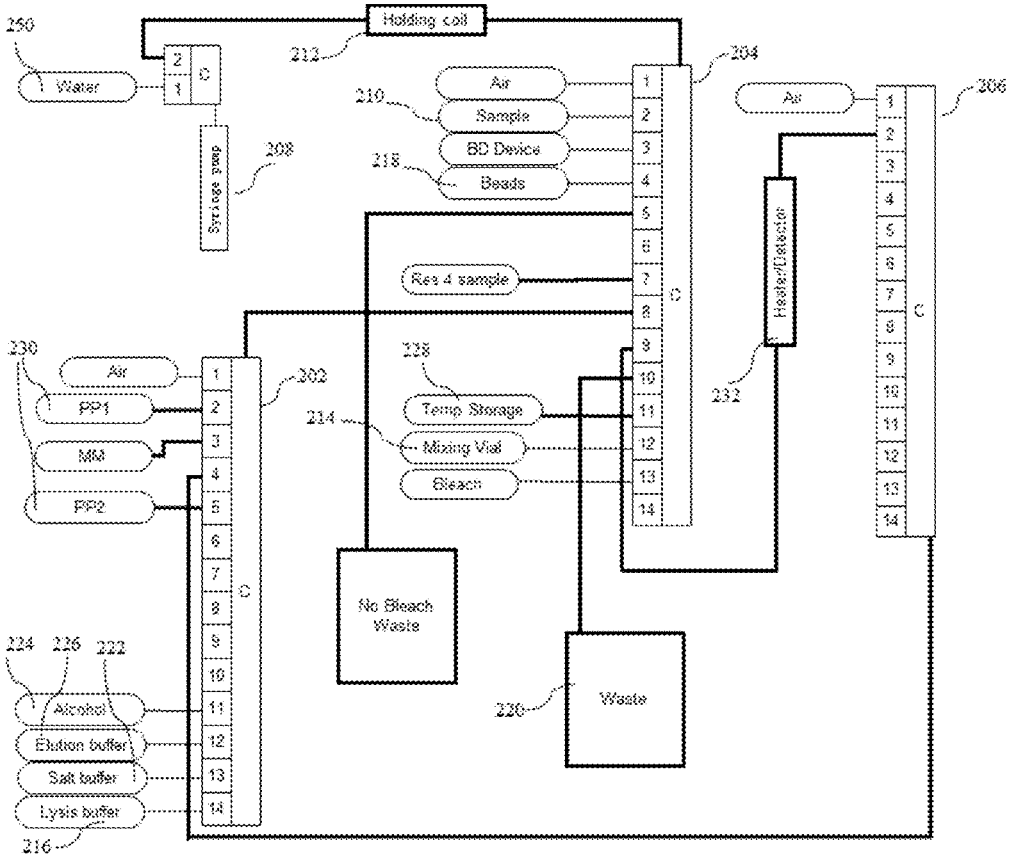
FIG. 2 depicts a fluidics connection diagram of a fluidics platform for extracting and detecting nucleic acid from a blood sample, according to several embodiments herein described.

FIG. 2 shows an exemplary fluidics connection diagram of the fluidics platform. In particular, the fluidics platform comprises three multiport valves (202, 204, 206) cascaded together. The common port of valve 202 is coupled to branch port 8 of valve 204. The common port of valve 206 is coupled to branch port 4 of valve 202. The common port of valve 204 is coupled to the holding coil (212), which is connected to the syringe pump (208). Some of the branch ports are coupled to reservoirs adapted to house various reagents, samples or wastes (250, 230, 224, 226, 222, 216, 210, 220, 218). Some branch ports are coupled to a chamber or a vial where the samples and/or reagents are mixed (214). Some branch ports are coupled to an air supply, such as branch port 1 of valve 202, 204 and 206. Also shown in FIG. 2 are a BD Vacutainer® blood test tube coupled through a sealed access interface with branch port 3 of valve 204 and a reaction and detection unit (232) coupled to branch port 9 of the same valve. An exemplary procedure of isolating and amplifying DNA from a blood sample using the fluidics platform as depicted in FIG. 2 can be found in Examples 1 and 2.

As described above, a reagent is drawn from a reservoir to the holding coil (106), from where the reagent is then pushed into the mixing chamber (130). In particular, the platform may transfer multiple samples and/or reagents into the mixing chamber (130) by repeating such a transfer procedure. Then, a mixing mechanism designed for the mixing reservoir (130) is activated. In some embodiments, the mixing can be performed shaking the mixing reservoir (130). In other embodiments, the mixing reservoir (130) contains magnetic stirrers, and the mixing can be performed through rotating the magnetic stirrers. In another further embodiment, the mixing can be performed through transferring air into the mixing reservoir (13), causing a bubbling action which acts to mix the reagents. Other suitable mixing mechanisms can be recognized by one with ordinary skill in the art upon reading of the present disclosure.

According to several embodiments herein described, the fluidics platform is configured to perform sample processing, which includes but is not limited to sample mixing, purification, washing, and drying.

Particularly, in some embodiments, the fluidics platform comprises a mechanism for solid-phase extraction of a target component from a sample. The extraction mechanism comprises micro-particles adapted to adsorb the target component upon contacting with the sample and particle-holding means adapted to capture the particles while the adsorbed target component is separated from the residual of the sample.

In some embodiments, the particles are magnetic beads, and the particle-holding means comprises a magnet. After contacting the magnetic beads with the sample under a suitable condition to allow the adoption of the target component by the beads, a magnet is placed in close proximity to the mixing chamber (130) to allow attraction of the beads to the magnet. Then the residue of the sample is drawn out of the mixing chamber (130) by the pump, while the beads carrying the target component is retained in the mixing chamber (130).

After extraction of the target component from the sample, additional reagents may be applied to wash the beads and the extracted component. In particular, the magnet is moved away from the chamber and a washing buffer is drawn into the mixing chamber (130) to resuspend the beads. Then the magnet is again placed in close proximity to the chamber (130), and the used washing buffer is drawn out by the pump (102).

After one or more rounds of washing, the beads and the extracted components may be dried. In particular, in some embodiments, the fluidics platform further comprises a heater (404) adapted to warm up the mixing chamber (103) and the beads comprised within from outside of the chamber (130). The platform may further comprise an air blower (402) adapted to deliver flowing air into the mixing chamber (130) in order to accelerate evaporation.

After the drying step, elution buffer may be applied to elute the extracted component off the beads. In particular, the magnet is moved away from the chamber, and elution buffer is drawn into the mixing chamber (130) to resuspend the beads. After the extracted component is released into the elution buffer, the magnet is again placed in close proximity to the chamber (130) in order to retain the beads in the chamber (130) while the elution buffer carrying the extracted component are drawn out.

In some embodiments, one of the reservoirs contains a fluidic suspension of the micro-particles, so that a suitable amount of particle slurry may be drawn into the mixing chamber (130) for extraction purpose when necessary. Used particles may be resuspended in water or other suitable agent as slurry, and drawn into a waste reservoir (220) for disposal.

In some embodiments, the above described mixing, extraction, washing, drying and elution steps can be performed in the same chamber, such as the mixing chamber (130). Alternatively, in other embodiments, the different steps of sample preparations may be performed in different chambers to avoid contamination between steps. In some embodiments, the fluidics platform may comprise reservoirs (250) of water or other cleaning agent for cleaning the fluidics paths of the platform between steps or samples.

In some embodiments, the fluidics platform may comprise a reservoir (228) for storage of an intermediate product of sample processing. In some embodiments, the fluidics platform may comprise a reservoir for collecting a waste (220).

According to several embodiments herein described, a processed sample, or a sample-reagent mixture can be transferred to a reaction and detection unit using a similar transfer procedure described above. As shown in FIG. 1, the reaction and detection unit (132) is connected to branch port 120 with a reaction tube (142). The sample-reagent mixture may be further mixed while it flows through the reaction tube (142). Particularly, the sample and/or reagent plugs (138) may be mixed by pumping back and forth within in a suitable region (136) of the reaction tube (142) before reaching the reaction and detection unit (132).

The reaction and detection unit (132) is adapted to allow chemical reaction among the mixed samples and/or reagents, and provides a means to detect the occurrence of such reaction. An exemplary embodiment of the reaction and detection unit (132) is described in a related patent application, titled "A fluidics Cartridge And Reaction Platform", Ser. No. 13/228,384, filed on even date herewith, herein incorporated by reference in its entirety.

Figure 3:
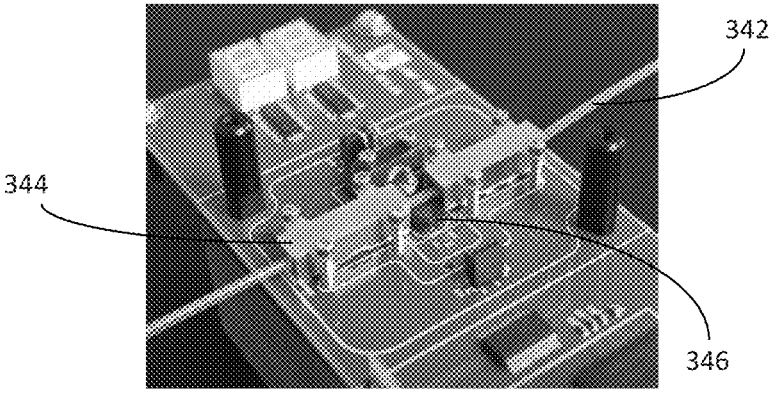
FIG. 3 depicts an exemplary embodiment of a reaction and detection unit of the fluidics platform herein described.

Another exemplary embodiment of the reaction and detection unit (132) is depicted in FIG. 3. The reaction and detection unit (332) comprises a reaction tube (342), a heater (344) and a detector (346). The reaction tube (342) is adapted to receive a reagent and/or sample plug from the fluidics platform. The heater (344) comprises two hollow heating blocks, which surround the wall of the reaction tube (342). Detection mechanisms which form part of the detector (346) are arranged between the two heating blocks (344). The reagent and/or sample plug is held at a suitable position within the reaction tube (342) so that the sample and/or reagent plug may be heated properly by the heater (344) and the reaction may be detected properly by the detector (346).

In order to prevent the reagent and/or sample from flowing away from the suitable position in the reaction and detection unit (232), the reaction plug may be assembled between two air bubbles or air plugs. Particularly, water may be first delivered into the reaction tube (142) forming a water plug of certain length. Then suitable amount of air is delivered followed by one or more reagents and/or samples. In this way, a first air bubble or air plug is formed between the water plug and the reaction plug. After that, another suitable amount of air is delivered followed by water or subsequent reagents and/or sample. Thus the reaction plug is sandwiched between two air bubbles, which hold the reaction plug at a designated position while the reaction plug is heated during the reaction (Example 2).

In the above embodiment, discontinuous sample and/or reagent plugs may be delivered to the reaction and detection unit (132) one after another, so that sequential detection of chemical reactions of different sample and/or reagent mixtures can be performed. In addition, adjacent sample and/or reagent plugs may be isolated by an air plug of a suitable length. When necessary, a suitable amount of water and/or other cleaning agents may be delivered between adjacent sample and/or reagent plugs in order to remove residuals left in the reaction tube (142).

According to several embodiments herein described, the fluidics platform may extract nucleic acid from a blood sample, and subsequently amplify and detect a target nucleic acid molecule from the extraction. In particular, in some embodiments, the target nucleic acid is produced by a blood-borne pathogen. Accordingly, amplification of the target nucleic acid molecule from the blood sample can be used for diagnosis purposes.

Depending on the types of reactions, the heater (134) may heat the sample and/or reagent mixture that is held in the reaction tube (142) to a constant temperature suitable for the reaction to take place. Exemplary isothermal reactions according to the present disclosure include but are not limited to isothermal nucleic acid amplifications, such as Loop-mediated Isothermal Amplification (LAMP), Helicase-Dependent isothermal Amplification (HDA), Recombinase Polymerase Amplification (RPA), and Multiple Displacement Amplification (MDA). Alternatively, the heater (134) may adjust the reaction temperature according to a pre-determined program, such as a thermal cycling, i.e., alternately heating and cooling according to a defined series of temperature steps. Exemplary thermal cycling reactions according to the present disclosure include but are not limited to Polymerase Chain Reaction (PCR).

Also depending on the types of reactions, different detection mechanisms may be used, including but not limited to fluorescence detection, impedance sensing, conductivity sensing, and light absorbance. In some embodiments, the detection is performed using the fluorescence detection system and method as described in a related patent application entitled "A System And Method For Measuring Fluorescence Of A Sample" having a Ser. No. 13/228,361, filed on even date herewith, herein incorporated by reference in its entirety.

According to some embodiments herein described, the fluidics platform may be manually operated by a user. For example, the user may manually operate the syringe pump (102) by pulling or pushing the plunger of the syringe (104). The user may manually switch the multiport valve (118) to selectively connect the main port (110) to one of the branch ports (112, 114, 116, 118, 120). The user may also manually couple or uncouple a magnet with the mixing chamber (130) for solid-phase extraction of a sample component. Manual operation may be desired at the point of care or when no electrical power is available, such as under a disastrous condition or during a power outage.

In other embodiments, a computer (140) may be used to control and operate the fluidics platform. Particularly, the computer (140) may control the various mechanical parts of the platform, such the multiport valve (108) and the particle-holding means. The computer (140) may also provide programs for automated analysis procedures and customized analysis programs. These programs specify analysis parameters such as sequences of reagents to be used, flow rates, sample or reagent volume, reaction temperature, mixture time, reaction time, detection mechanisms, etc. A user of the platform may select one of the pre-set programs or create a customized program to configure and operate the fluidics platform for automated, reagent/sample handling, sample processing, reaction and detection.

EXAMPLES

The fluidics platform and related methods herein disclosed are further illustrated in the following examples, which are provided by way of illustration and are not intended to be limiting.

Example 1

Solid-Phase Extraction of Nucleic Acid from a Whole Blood Sample

Figure 4:
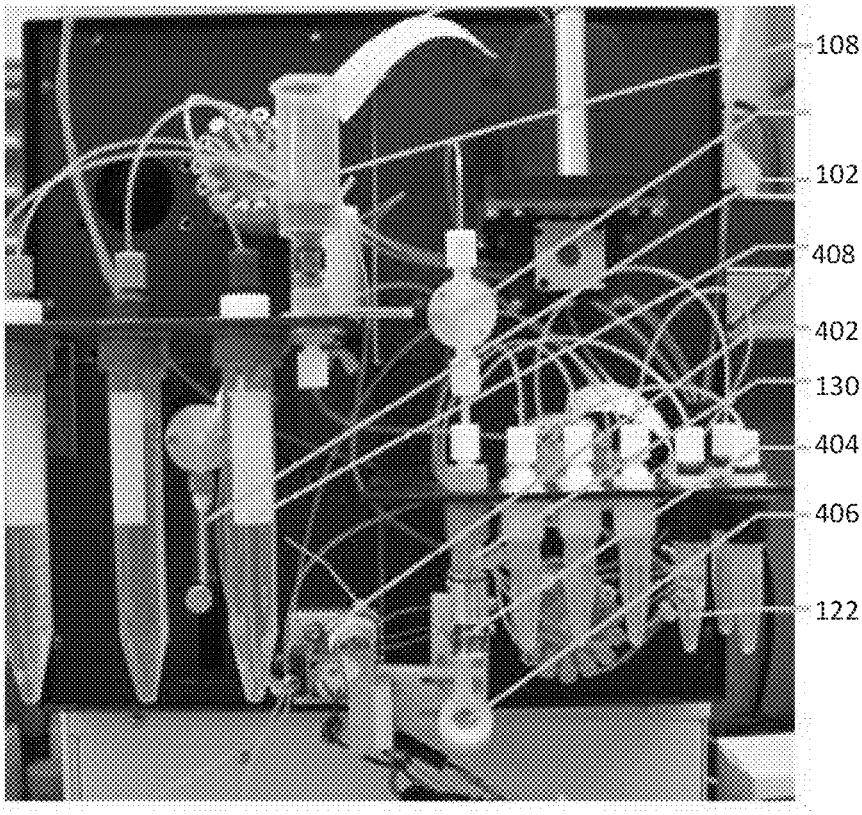
FIG. 4 depicts a photo of an exemplary embodiment of the fluidics platform showing fluidics connections between a pump, reservoirs and valves.

To extract DNA from a blood sample using a fluidics platform as depicted in FIG. 2, the syringe pump (208) first draws around 100 μL of blood from the blood sample reservoir (210) through multiport valve 204 to the holding coil (212) and then pushes the blood from the holding coil (212) through multiport valve 204 to the mixing chamber (214). Similarly, lysis buffer is transferred from the lysis buffer reservoir (216) to the mixing chamber (214), and magnetic beads are transferred from the beads reservoir (218) to the mixing chamber (214). Then, air is bubbled into the mixing chamber (214) and mixes the mixture inside the mixing chamber (214). After lysing and mixing, DNA in the sample is adsorbed by the magnetic beads. Then, a magnet (406 in FIG. 4) is moved into close proximity of the mixing chamber (214) and attracts the magnetic beads which carry the DNA to the wall of the mixing chamber (214). The liquid in the mixing chamber (214) is then removed from the mixing chamber (214) and transferred to the waste reservoir (220). The magnet (406) is then moved away from the mixing chamber (214) and washing agents are added to the mixing chamber (214). Air is again bubbled into the mixing chamber (214) to resuspend the magnetic beads in the washing buffer. The washing procedure is then repeated and the beads and extracted DNA are washed three times with lysis buffer (stored in reservoir 216), two times with a salt solution (stored in reservoir 222), and one time with an alcohol solution (stored in reservoir 224). A heater (404 in FIG. 4) then warms the beads in the mixing chamber (214) and an air pump (402 in FIG. 4) blows air into the mixing chamber (214) until residual alcohol evaporates. Next, elution buffer is transferred from the elution buffer reservoir (226) to the mixing chamber (214). The beads are held in place by the magnet and the elution buffer (now carrying DNA) is then transferred from the mixing chamber (214) to the temporary storage reservoir (228).

Example 2

LAMP Amplification of Extracted Nucleic Acid from a Whole-Blood Sample

To amplify the extracted DNA using LAMP, the holding coil (212) is first fill with water. Then 10 μL of air, 18 μL of amplification reaction buffer comprising a fluorescent dye, 6 uL of DNA in elution buffer, 6 μL of LAMP primers, and 10 μL of air are sequentially transferred into the holding coil (212). In particular, the solution of eluted DNA is drawn from the temporary storage reservoir (228) and the LAMP primers from the primer reservoirs (230). The sample and/or reagent plugs are transferred to the reaction and detection unit (232) through the reaction tube (242). During the transfer process, the sample and/or reagent plugs are pumped back and forth to mix in the reaction tube. Then the mixed sample-reagent plug (30 μL) is pumped into the reaction and detection unit (232) with the two 10 μL it air plugs sealing the mixture in between. The reaction and detection unit (232) comprises a heater which warms up the sample-reagent plug to 65° C. for one hour. A fluorescence detector (346 in FIG. 3) monitors the fluorescence increase in the sample-reagent plug, which indicates amplification of nucleic acid.

The examples set forth above are provided to give those of ordinary skill in the art a complete disclosure and description of how to make and use the embodiments of the a fluidics platform and method for sample preparation and analysis of the disclosure, and are not intended to limit the scope of what the inventors regard as their disclosure. Modifications of the above-described modes for carrying out the disclosure can be used by persons of skill in the art, and are intended to be within the scope of the following claims.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a", "an", and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications can be made without departing from the spirit and scope of the present disclosure. Accordingly, other embodiments are within the scope of the following claims.

LIST OF REFERENCES

1. Rapid and Simple Method for Purification of Nucleic Acids. Boom, R. et al. J. Clin. Microbial. 1989 28:495-503.
2. Process for Isolating Nucleic Acid. Boom, Adriannse, Kievits, Lens, 1993 U.S. Pat. No. 5,234,809.
3. Rapid isolation of genomic DNA from whole blood to borosilicate particles. Bush, C. and M. Harvey, 1991 Clin. Chem. 37:1060.
4. SmartCycler System Brochure, Cepheid http://www.cepheid.com/media/files/brochures/SC Brochure.pdf
5. Bio-Seeq PLUS brochure, Smiths Detection http://www.smithsdetection.com/eng/Bio-Seeq PLUS.php
6. An integrated portable hand-held analyser for real-time isothermal nucleic acid amplification, M. C. Smith et al. Analytica Chimica Acta, 2007 598: 286-294
7. SeptiFast Brochure, Roche http://molecular.roche.com/commonfiles/media/pdf/51septifast.pdf 8. GeneXpert System Brochure 0112-04, Cepheid http://www.cepheid.com/media/files/brochures/GeneXpert%20Brochure 0112-04.pdf
9. Bio-Seeq Product Summary, Smiths Detection http://www.smithsdetection.com/media/Bioseeq_Ciinical_product_summary021809.pdf
10. Maxwell 16 DNA Purification Kits, Promega Technical Manual 284 Promega_Maxwell_TM284.pdf

What is claimed is:

1. A fluidics platform comprising:

at least one reservoir adapted to comprise a fluidic content;

a first multiport valve, comprising a common port and at least two branch ports;

a pump connected to the common port through a holding coil; and a mixing chamber connected to a first branch port of the at least two branch ports, wherein a second branch port of the at least two branch ports is connected to the at least one reservoir, wherein the common port is configured to switchably connect to one of the at least two branch ports at a time, and the pump is configured to draw the fluidic content from the at least one reservoir through the second branch port and the common port into the holding coil and to expel the drawn content from the holding coil through the common port and the first branch port into the mixing chamber.

2. The platform of claim 1, further comprising a computer configured to operate the fluidics platform.

3. The platform of claim 2, wherein the computer is configured to operate the multiport valve.

4. The platform of claim 1, further comprising a sealed access interface adapted to connect to the at least one reservoir and to avoid open transferring of the fluidic content of the reservoir to other locations in the platform.

5. The platform of claim 1, wherein the pump is a syringe pump.

6. The platform of claim 1, further comprising one or more additional multiport valve, wherein the one or more additional multiport valve is cascaded with the first multiport valve.

7. The platform of claim 1, further comprising magnetic beads and a movable magnet, the magnetic beads and magnet adapted to perform solid-phase extraction of a component from a sample.

8. The platform of claim 1, further comprising a first heater adapted to heat dry a sample.

9. The platform of claim 1, further comprising an air blower adapted to air dry a sample.

10. The platform of claim 1, further comprising a reaction and detection unit, wherein the reaction and detection unit comprises a reaction tube and a detector, wherein the reaction tube is adapted to receive a reaction mixture from one of the at least two branch ports, and to hold the reaction mixture at a position suitable for detecting a reaction by the detector.

11. The platform of claim 10, wherein the detector comprises a fluorescence detector and an excitation source.

12. The platform of claim 10, wherein the reaction and detection unit further comprises a second heater; and wherein the reaction tube is adapted to hold the reaction mixture at a position suitable for heating the reaction mixture by the second heater.

13. The platform of claim 12, wherein the second heater comprises two heating blocks adapted to surround a portion of the reaction tube, wherein the surrounded portion of the reaction tube comprises the reaction mixture; and wherein the detector is arranged between the two heating blocks to detect the reaction.

14. The platform of claim 1, wherein the fluidic content is selected from the group consisting of a sample, a reagent, water, a clean agent, air, magnetic beads and waste.

15. The platform of claim 1, wherein the mixing chamber contains magnetic stirrers.

* * * * *